US009678454B2

(12) United States Patent
Gila et al.

(10) Patent No.: US 9,678,454 B2
(45) Date of Patent: Jun. 13, 2017

(54) LIQUID ELECTROGRAPHY PRINTING

(71) Applicant: HEWLETT-PACKARD DEVELOPMENT COMPANY, L.P., Fort Collins, CO (US)

(72) Inventors: Omer Gila, Palo Alto, CA (US); Seongsik Chang, Palo Alto, CA (US); Michael H. Lee, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/916,413

(22) PCT Filed: Sep. 6, 2013

(86) PCT No.: PCT/US2013/058559

§ 371 (c)(1),
(2) Date: Mar. 3, 2016

(87) PCT Pub. No.: WO2015/034523

PCT Pub. Date: Mar. 12, 2015

(65) Prior Publication Data

US 2016/0216631 A1 Jul. 28, 2016

(51) Int. Cl.

| | |
|---|---|
| ***G03G 15/02*** | (2006.01) |
| ***G03G 15/10*** | (2006.01) |
| ***G03G 15/043*** | (2006.01) |

(52) U.S. Cl.

CPC ..... *G03G 15/0266* (2013.01); *G03G 15/02* (2013.01); *G03G 15/0216* (2013.01); *G03G 15/043* (2013.01); *G03G 15/10* (2013.01)

(58) Field of Classification Search

USPC ..... 399/115, 168, 170–176

See application file for complete search history.

(56) References Cited

U.S. PATENT DOCUMENTS

| | | | | |
|---|---|---|---|---|
| 6,144,827 | A * | 11/2000 | Iikura | G03G 15/11 399/249 |
| 6,269,233 | B1 * | 7/2001 | Yamaguchi | G03G 15/11 399/164 |
| 8,351,815 | B2 | 1/2013 | Eden et al. | |
| 2002/0086148 | A1 | 7/2002 | Tarnawskyj et al. | |
| 2011/0020036 | A1 | 1/2011 | Bhattacharyya et al. | |
| 2011/0069987 | A1 | 3/2011 | Chang et al. | |
| 2012/0027468 | A1 | 2/2012 | Nelson et al. | |
| 2013/0011162 | A1 | 1/2013 | Nelson et al. | |

FOREIGN PATENT DOCUMENTS

| | | |
|---|---|---|
| EP | 1079281 | 2/2001 |
| EP | 1528437 | 5/2005 |
| JP | 10221926 | 8/1998 |
| JP | 2003295583 | 10/2003 |
| JP | 2011002785 | 1/2011 |
| JP | 2011197216 | 10/2011 |
| WO | WO-9422059 | 9/1994 |

* cited by examiner

*Primary Examiner* — Hoan Tran

(57) ABSTRACT

Techniques for liquid electrography printing are described herein. In at least some examples herein, a liquid electrographic printer includes a charging element for charging a photo imaging plate (PIP). A light source irradiates light onto the charge element. The irradiated light is to heat the charge element to a selected temperature.

15 Claims, 5 Drawing Sheets

LIQUID ELECTROGRAPHY PRINTING

CROSS-REFERENCE TO RELATED APPLICATIONS

This Utility Patent Application is a U.S. National Stage filing under 35 U.S.C. §371 of PCT/US2013/058559, filed Sep. 6, 2013, incorporated by reference herein.

BACKGROUND

Electrophotography is a popular imaging technique. In liquid electrophotography, a photo imaging plate (PIP) is charged via a charging element. The PIP may be, for example, an organic photoconductor drum. Then, a latent image is formed on the charged photoconductor via, for example, a scanning laser beam (for printing). Then, the latent image is developed with colorant particles provided via a liquid electro-ink. The latent image is subsequently transferred to a print media by a combination of pressure and electrostatic attraction.

For charging the PIP, the charging element may include a charge roller or a corona wire to facilitate uniformly charging the photoconductor. For performing this task, the charge roller is brought into close proximity to the photoconductor.

BRIEF DESCRIPTION OF THE DRAWINGS

In order that the present disclosure may be well understood, various examples will now be described with reference to the following drawings.

DETAILED DESCRIPTION

In the following description, numerous details are set forth to provide an understanding of the examples disclosed herein. However, it will be understood that the examples may be practiced without these details. While a limited number of examples have been disclosed, it should be understood that there are numerous modifications and variations therefrom. Similar or equal elements in the Figures may be indicated using the same numeral.

As set forth above, a charge element, such as a charge roller or a corona wire is used in at least some liquid electrophotographic printers for uniformly charging the photoconductor. For charging, the charge element is brought into close proximity to the photo imaging plate (PIP). However, during printing, the charge element might get contaminated by electro-ink being used for printing. For example, vapor from the electro-ink may condense onto a charge roller. Furthermore, plasma discharges from the charge element may cause polymerization of the condensed material thereon. Consequently, a liquid electrophotographic printer might require servicing to clean the charge element. Cleaning prevents charging disruptions and/or transfer of contamination from the charge element to the PIP.

In at least some of the examples herein, a light source is implemented to irradiate light onto a charge element of a liquid electrographic printer. The irradiated light is to heat the charge element to a selected temperature (which might be a selected temperature range). Thereby, contamination formation onto the charge element might be prevented by promoting evaporation of contaminating electro-ink (or any of its components) formed on the charge element. Irradiated light is a convenient means for contamination prevention since it can be tuned to specifically evaporate a specific type of contamination. For example, wavelength and intensity of the irradiated light might be selected for sufficiently evaporating electro-ink (or any of its components) on the charge element.

Figure 1:
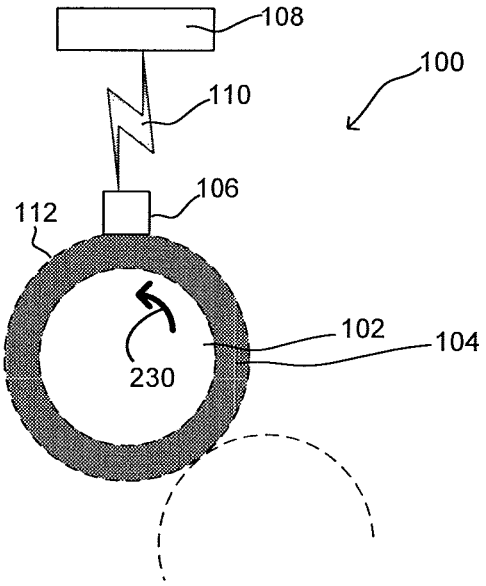
FIG. 1 is a schematic block diagram of a liquid electrographic printer according to examples.

FIG. 1 shows a schematic block diagram of a liquid electrophotographic printer 100 according to examples herein. As used herein, "liquid electrophotographic printer" refers to a printer that creates a printed image from digital data by forming an inked image on a photo imaging plate (PIP) using an electro-ink. In liquid electrophotographic printers, the inked image may be transferred to a blanket element, and the inked image may be further transferred from the blanket element to a substrate held by an impression element.

Printer 100 includes an imaging element 102 to support, during operation of printer 100, a photo imaging plate (PIP) 104. A charge element 106 is in the proximity of imaging element 102 to electrostatically charge PIP 104 during operation of printer 100. Charge element 106 may be on contact with PIP 104 or separated therefrom by a gap. Printer 100 further includes a light source 108 to irradiate light 110 onto charge element 106. Printer 100 may include further elements to perform printing such as shown in the more specific example of FIG. 2.

In FIG. 1, imaging element 102 is illustrated as a cylinder that supports PIP 104, which is shown shaped cylindrically. Charge element 106 may be provided with other geometries. For example, imaging element 102 may be provided as a conveyor belt supporting a sheet-like PIP thereon. A PIP may include any suitable material onto which an electrostatic latent image can be formed. For example, PIP 220 may include a photoconductor chargeable by charge element 106. Once charged, a latent image can be formed onto the photoconductor via selected light exposure as further set forth below with respect to FIG. 2. Charge element 106 may include, for example, a corona wire or a charge roller to generate charges that flow towards a PIP surface 112 to facilitate uniform charging thereof.

Light source 108 may include any light source that irradiates electromagnetic radiation suitable to at least mitigate effects of contamination on charge element 106 via heating. The electromagnetic radiation might include visible and/or non-visible light. Light source 108 might include electromagnetic radiation sources such as, but not limited to, an IR lamp, a suitable heating coil, a Xenon source, or a bulb lamp. In the following, the term "light" is used as a synonym of electromagnetic radiation. In particular, it is not limited to visible light.

During operation of printer 100 for printing an image onto a substrate (not shown in FIG. 1), charge element 106 charges PIP 104. Further, light source 108 irradiates light onto charge element 106 so as to heat charge element 106 to a selected temperature. Thereby, irradiated light 110 prevents contamination formation onto charge element 106. Moreover, irradiated light 110 may also promote evaporation of contamination already formed on charge element 106. Light irradiation might be performed continuously or at selected time frames.

Figure 2:
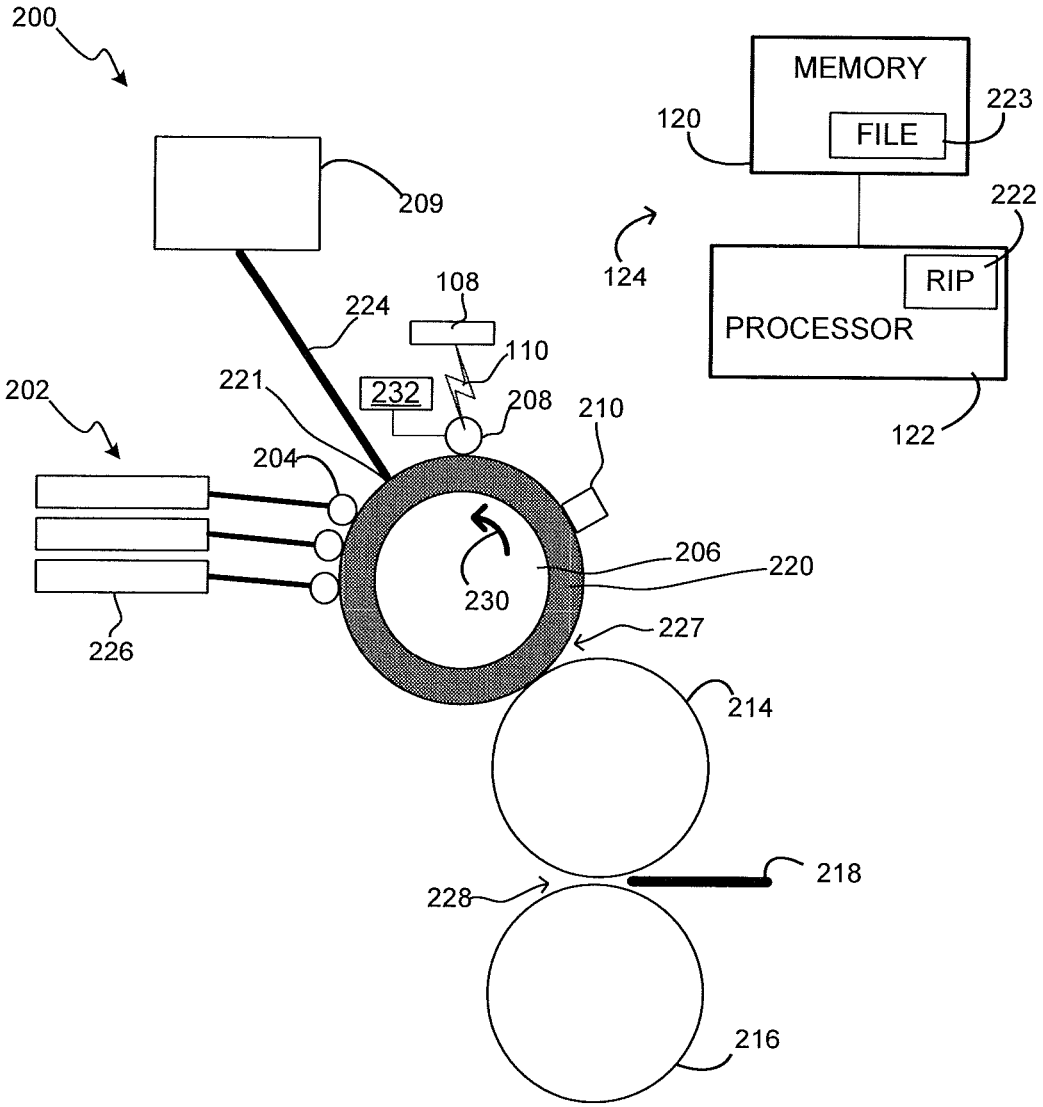
FIG. 2 is a schematic block diagram of another liquid electrographic printer according to examples.

FIG. 2 illustrates more specifically examples of liquid electrographic printers according to examples herein. It will be understood that the example of FIG. 2 is merely illustrative. There is a variety of configurations available for implementing liquid electrographic printers. Indigo Digital Printing Presses are examples of liquid electrographic printers.

Liquid electrographic printer 200 is shown in FIG. 2 to include electro-ink suppliers 202, developers 204, an imaging cylinder 206, a charge roller 208 to electrostatically charge a photo imaging plate (PIP) 220 mounted on imaging cylinder 206, a light source 108 to irradiate light 110 onto charge roller 208, an imager unit 209 to form an electrostatic image on PIP 220, a removal system 210 of residual ink and electrical charge from PIP 220, and an impression cylinder 216 to hold a substrate 218 to be printed. Printer 200 may include a control system 124 being comprised of a processor 122 communicatively coupled to a memory 120 for controlling operation of printer 200.

Charge roller 208 may be operatively connected to a temperature acquisition system 232 for acquiring temperature of charge roller 208 during operation of printer 200. Temperature acquisition system 232 may include any suitable temperature acquisition system for acquiring temperature of charge roller 208 such as, but not limited to a thermocouple transducer, a resistive transducer, a charge roller current monitoring system or a combination thereof.

During operation of printer 200 for printing an image onto substrate 218, charge roller 208 uniformly charges PIP 220. PIP 220 may include a photoconductor film attached to the surface of imaging cylinder 206.

As PIP 220 continues to rotate, a charged PIP section 221 passes imager unit 209. Imager unit 209 forms an electrostatic image on charged PIP section 221 by scanning one or more laser beams 224 on section 221 of PIP 220. When laser beam 224 exposes charged areas of PIP section 221, it dissipates (neutralizes) charge in those areas (the charge being previously provided by charge roller 208). Thereby, an electrostatic image is formed (also referred to as latent image) in the form of an electrostatic charge pattern that replicates the image to be printed on substrate 218. Imager unit 209 may be controlled by a raster image processor (RIP) 222 implemented at control system 124. RIP 222 converts instructions from a digital file 223 into "on/off" instructions for lasers controllers (not shown) at imager unit 209.

Developers 204 (e.g. binary ink developers), may then ink a section of PIP 220 containing a portion of a latent image with charged electro-ink (e.g., a liquid electrophoretic ink). Generally, there is a developer for each basic color available to printer 200. It will be understood that printer 200 may include any number of developers suitable for a specific application. The basic colors correspond to electro-inks to be supplied by tanks 226. These basic colors define the color gamut of printer 200.

The charged electro-ink coats the surface of PIP 220 according to the formed electrostatic image so as to form an ink pattern thereon. FIG. 2 shows three developers 204 for the sake of illustration.

The surfaces of PIP 220 and blanket cylinder 214 contact at a transfer area 227. Thereby, the ink image formed on the surface of PIP 220 may be transferred to the surface of blanket cylinder 214.

A blanket heating system (not shown) may heat the inked image carried by blanket cylinder 214. For example, blanket cylinder 214 may be heated to approximately 100° C. to cause pigment carrying particles of the electro-ink to melt and blend into a smooth liquid plastic before reaching a further transfer area 228 in which the surface of blanket cylinder 214 contacts substrate 218 held by impression cylinder 216. When the heated electro-ink on blanket cylinder 214 contacts the cooler substrate 218, the electro-ink solidifies, adheres, and transfers to substrate 218.

Removal system 210 may remove any residual ink and/or electrical charge on PIP 220 so that a new ink image can be formed thereon. More specifically, downstream transfer area 227, removal system 210 may (i) remove excess liquids and ink particles from the non-image areas on the surface of PIP 220, and (ii) cool the surface of PIP 220. For example, two small rollers (wetting roller and reverse roller, not shown) may be configured to rotate opposite to direction 230, i.e. the rotation direction of PIP 220. The reverse roller may be mounted in close proximity to the surface of PIP 220. Thereby, it may exert a combination of electrodynamic and hydrodynamic forces that remove excess liquids and ink particles from the PIP surface. Ink removed from the PIP at this stage may be recovered in a catch tray (not shown) and sent to a separator (not shown).

The above described operation of printer 200 may be repeated for every color separation in an image.

During the above process, a portion of the electro-ink used for printing may reach charge roller 208. For example, printer 200 may use oil based electro-inks (i.e., electro-inks in which an oil such as Isopar-L is used as carrier). Removal system 210 may leave a thin oil layer (e.g., a layer of approximately 20 nm) on PIP 220. At least a portion of this oil layer may evaporate and condensate on charge roller 208 due to air flow over PIP 220 or during ionization and charging of PIP 220 via charge roller 208. Other elements of printer 200, e.g. heated blanket cylinder 214, may also act as sources of oil contamination on charge roller 208. Oil contamination on charge roller 208 may also contain vapor of heavier molecules from the electro-ink.

Once contamination condenses on charge roller 208 it may potentially polymerize due to ionic bombardment from the charge roller discharge. This process may result in the development of heavy chains of molecules onto charge roller 208. These heavy chains of molecules may stick to charge roller 208 and continue to accumulate as a thick, honey-like layer. This honey-like contamination may in particular interfere with charging of PIP 220 via charge roller 208. Moreover, such contamination may damage PIP 220. Therefore, formation of such a contamination may also force replacement of PIP 220.

To prevent formation of condensation on charge roller 208 or to promote evaporation of contamination already formed thereon, light source 108 irradiates light 110 so as to heat charge roller 208. Irradiated light 110 might heat charge roller 208 either directly or indirectly. Irradiated light might directly heat charge roller 208 by light absorption of the charge roller surface. Irradiated light might indirectly heat charge roller 208 by absorption of irradiated light 110 by contamination on charge roller 208.

There are a variety of options for configuring light source 108. In an example, the light source is an infrared (IR) light source. Infrared radiation might be in particular convenient for implementing examples herein since it falls into the absorption spectrum of electro-ink carriers (e.g., an Isopar-L oil). Thereby, light source 108 not only facilitates heating up charge roller 208 to a temperature sufficiently high to prevent contamination formation, but it can also promote fast evaporation of an electro-ink carrier (e.g., Isopar-L oil) condensed on charge roller 208 before it polymerizes.

Figure 3:
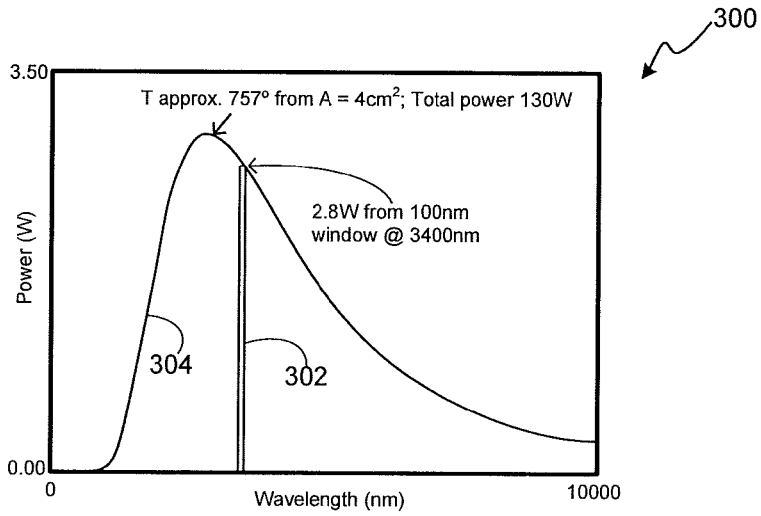
FIG. 3 is a schematic graph illustrating absorption of infrared radiation by Isopar-L oil according to examples.

An absorption spectrum 302 of Isopar-L oil is shown graph 300 of FIG. 3. A spectral curve 304 of IR light with a temperature of 757° C. from an irradiating surface of 4 $cm^2$ with a total power of 130 W is shown in graph 300. Graph 300 further shows an Isopar spectrum 302 corresponding to 2.8 W from a 100 nm absorption window at 3.4 μm. Graph 300 shows that Isopar spectrum 302 falls well within spectral curve 304 thereby indicating that Isopar-L oil can efficiently absorb such an IR light. As further illustrated below with respect to FIG. 6, a spectral graph such as graph 300 can be used to selecting the characteristics of light 110 being emitted by light source 108 for an efficient heating of charge roller 208.

Figure 4:
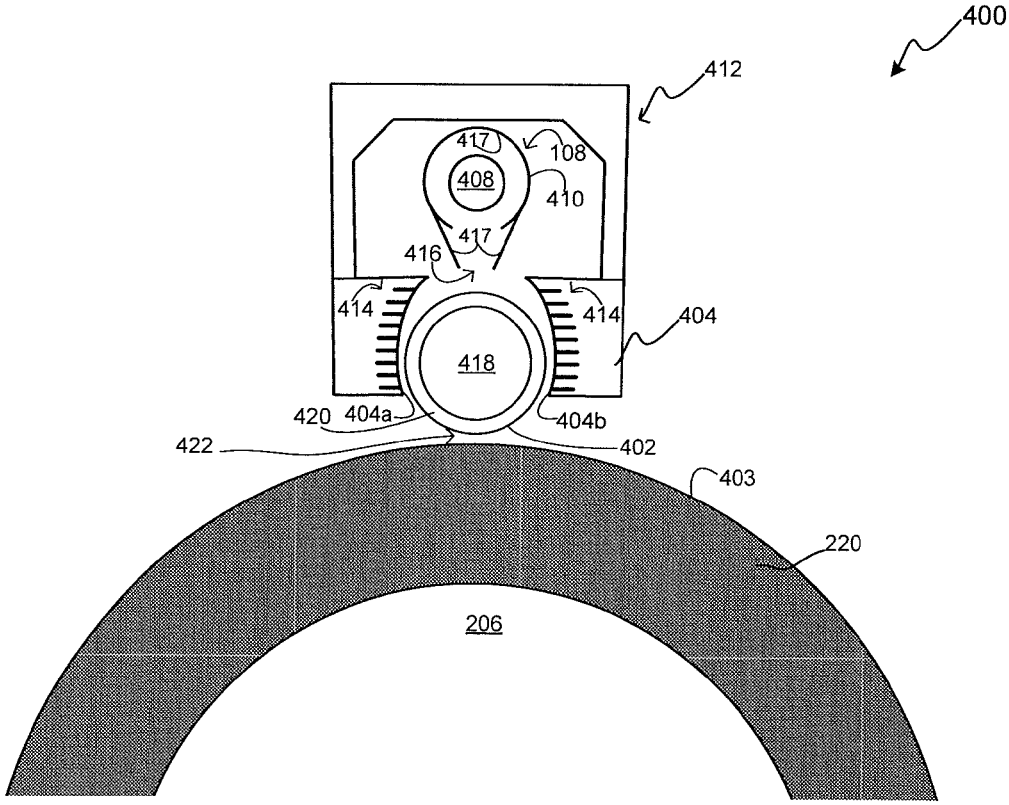
FIG. 4 is a schematic block diagram of a portion of a liquid electrographic printer according to examples.

FIG. 4 is a schematic block diagram of a portion of a liquid electrographic printer 400 according to examples. FIG. 4 shows a light source 108, a housing 404, and a charge roller 402 in charge-transferring relation to an imaging surface 403 of PIP 220.

Light source 108 is shown to include a lamp 408 for generating light (not depicted in FIG. 4) to be irradiated onto charge roller 402. As illustrated, light source 108 may include a light reflector 410 to reflect irradiated light towards charge roller 402. Further, as shown, printer 400 includes housing 404 for charge roller 402. Housing 404 prevents light irradiated from lamp 408 towards charge roller 402 to further propagate onto PIP 220 during operation of printer 400. Housing 404 might be particularly convenient in case that lamp 408 produces light that may potentially damage PIP 220 via electrical discharges. As shown, housing 404 may form part of a housing element 412 enclosing also light source 108. Thereby it is facilitated compact design and efficient use of light irradiated by lamp 408.

As set forth above, lamp 408 may be an IR lamp such as a 1500 W, 240V lamp. A quartz-halogen 1500T3Q/P/CL lamp from Philips might be used as lamp 408. Lamp 408 may be driven by an adjustable power source (not shown) so that the output power of the lamp can be regulated (e.g., by variation of an AC voltage). Lamp 408 may be shaped to irradiate light along charge roller 402. For example, lamp 408 may be elongated (e.g., cylindrically) and disposed in parallel to charge roller 402.

Light reflector 410 is generally designed to facilitate directing the maximum possible of light irradiated by lamp 408 towards charge roller 402. Light reflector 410 is shown including an opening 416. Opening 416 is disposed between lamp 408 and charge roller 402 so that a substantial portion of the irradiated light directly reaches charge roller 402. Light reflector 410 may include a reflecting inner surface 417 facing lamp 408 and shaped to reflect light not being directly focused towards charge roller 402 into an opening 416 of the reflector. Reflecting inner surface 417 might include evaporated aluminum or gold/chrome coatings on a smooth substrate to implement a reflective surface. Opening 416 is positioned in close proximity of charge roller 402 so that irradiated light efficiently reaches charge roller 402. Opening 416 may include a lens or any other suitable optical element for suitably distributing light along the surface of charge roller 402.

Charge roller housing 404 may be constituted in any suitable manner that prevents irradiated light from reaching PIP 220. For example, as illustrated, housing 404 may include walls 404*a*, 404*b* disposed closely and around charge roller 402. Thereby, it is facilitated that walls 404*a*, 404*b* absorb light being strayed by charge roller 402, or any other element within housing element 412. Otherwise, such a stray light might undesirably reach PIP 220.

Further, in the illustrated example, charge roller housing 404 is shown including light baffles 414. Light baffles 414 are to block stray irradiated light from reaching PIP 220. Light baffles 414 may feature large uniform grooves which are designed to absorb excess light. More specifically, baffles 414 may include fins that increase the light path of stray light. Baffles color may be selected to promote excess light absorption. For example, black baffles may be used to more efficiently absorb excess light. Baffles 414 may include, for example, high temperature plastic, anodize aluminum, or a combination thereof to promote absorption of strayed light.

In at least some examples herein, the used charge element is a charge roller that particularly resists heating via a light source as described herein. Therefore, in at least some examples herein, an inorganic charge roller may be used to improve longevity of the charge roller. Such inorganic charge rollers are in contrast to some other charge rollers that include a conductively-loaded, outer rubber portion. This rubber portion may deteriorate by repeated charging cycles and/or absorbed light irradiation from light sources described herein.

There are a plurality of options for implementing an inorganic charge roller. In an example, the inorganic charge roller is a metal charge roller. The metal body of the roller may be of, for example, stainless steel or aluminum. In such examples, it might be convenient to operate the metal charge roller in a normal glow discharge rather than in an arc discharge regime to prevent that pulsed discharges damage the PIP. Therefore, an operating voltage of the charge roller may be maintained below an arc discharge threshold. Multiple charge rollers may be used to facilitate maintaining a relatively low operating voltage for each roller. Further, an AC supply voltage may be used to operate the metal charge roller thereby preventing arc discharges. For example, printer 400 may include a power supply (not shown) to provide electric power to charge roller 402 with an alternating current (AC) component and a direct current (DC) component to the charging element. The AC component may have an amplitude between about 600 and 800 volts and a frequency between about 5 and 10 kHz.

In FIG. 4, a specific example of an inorganic charge roller is shown. In particular, charge roller 402 is shown to include a metal body 418 and an overlying resistive coating 420 made of an inorganic, non-polymeric material. Resistive coating 420 facilitates reducing maximum amplitudes of filamentary streamers between charge roller 402 and PIP 220 which may be generated in a gap 422 between charge roller 402 and PIP 220. Resistive coating 420 may have a resistivity factor sufficient to induce a substantially uniform charge transfer to PIP 220, such as a resistivity factor greater than $10^3$ Ohm-cm and less than about $10^9$ Ohm-cm.

Resistive coating 420 may include a semiconductor material such as silicon carbide, silicon, or hydrogenated silicon. Alternatively, resistive coating 420 may include an insulator material with electrically active defect states such as a material chromium oxide, aluminum oxide, aluminum oxide: titanium oxide, aluminum oxide: zinc oxide, or aluminum oxide: tin oxide.

In the absence of a resistive coating 420 on a metal external surface of charge roller 402, non-uniform charge distribution emanating from filamentary streamer discharges might otherwise lead to unacceptable alligator patterns in the printed output. In addition, a too high amplitude of filamentary streamer discharges may degrade performance of PIP 220.

In at least some examples herein, the charge roller is positioned so as to be, during printer operation, in a non-contact charge-transferring relation with the PIP. For example, as illustrated by FIG. 4, during operation of printer 400, charge roller 402 may be separated from PIP 220 by a gap 422. Gap 422 may be have any suitable distance that facilitates a uniform charge transfer from charge roller 402 to PIP 220, such as a distance between 20 micrometers to about 80 micrometers.

Further, gap 422 may be maintained by a control system (e.g., control system 124 depicted in FIG. 2). Thereby, it may be provided a closed loop control of the selectable gap. Such a closed loop control mechanism facilitates determining and maintaining a range of selectable gaps in which charge roller 402 may provide a charge that is generally uniformly distributed across the imaging surface of PIP 220. Furthermore, gap 422 facilitates heating of charge roller 402 via light source 108 as well as prevents contact damage of PIP 220.

Figure 5:
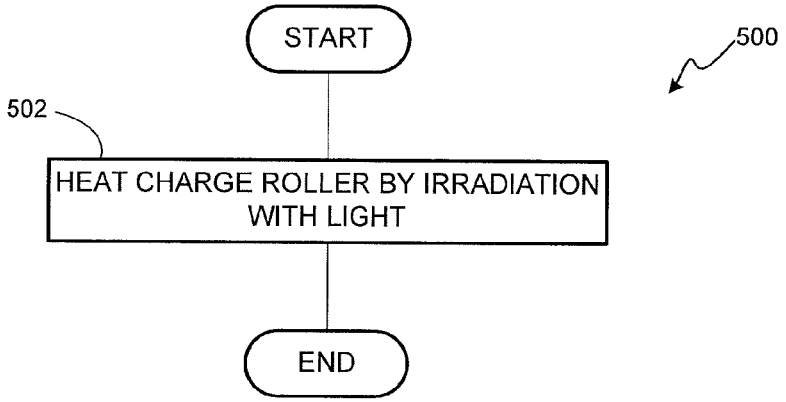
FIGS. 5 to 7 show flow charts for implementing at least some of the examples disclosed herein.
Figure 6:
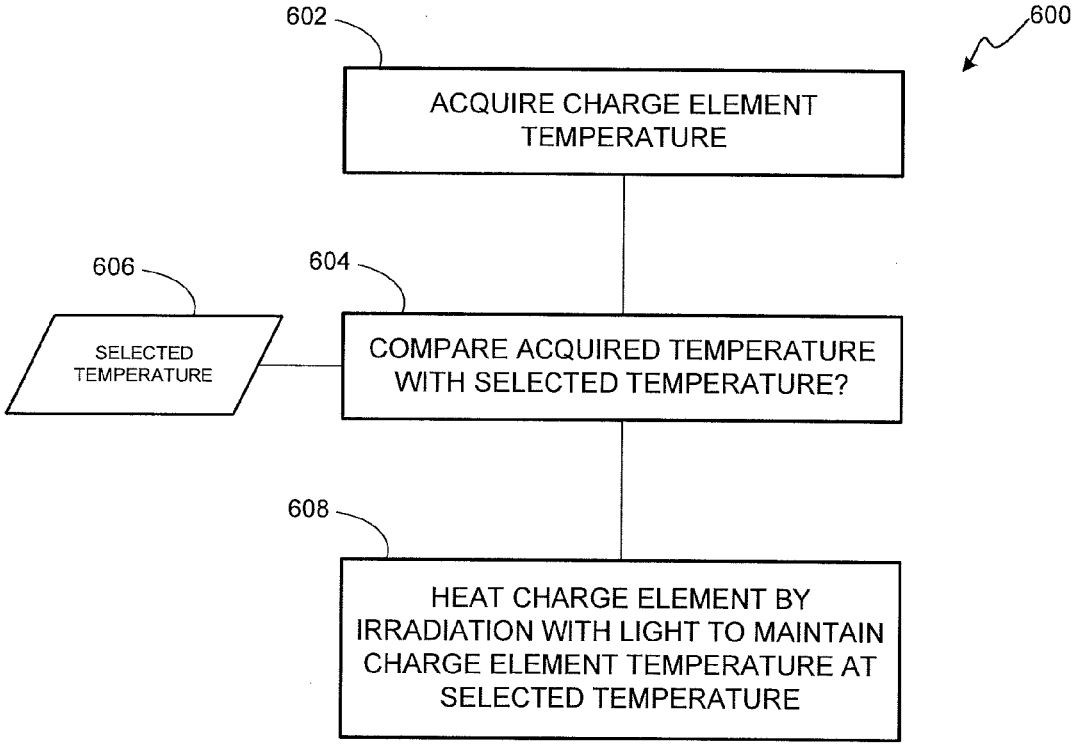
Figure 7:
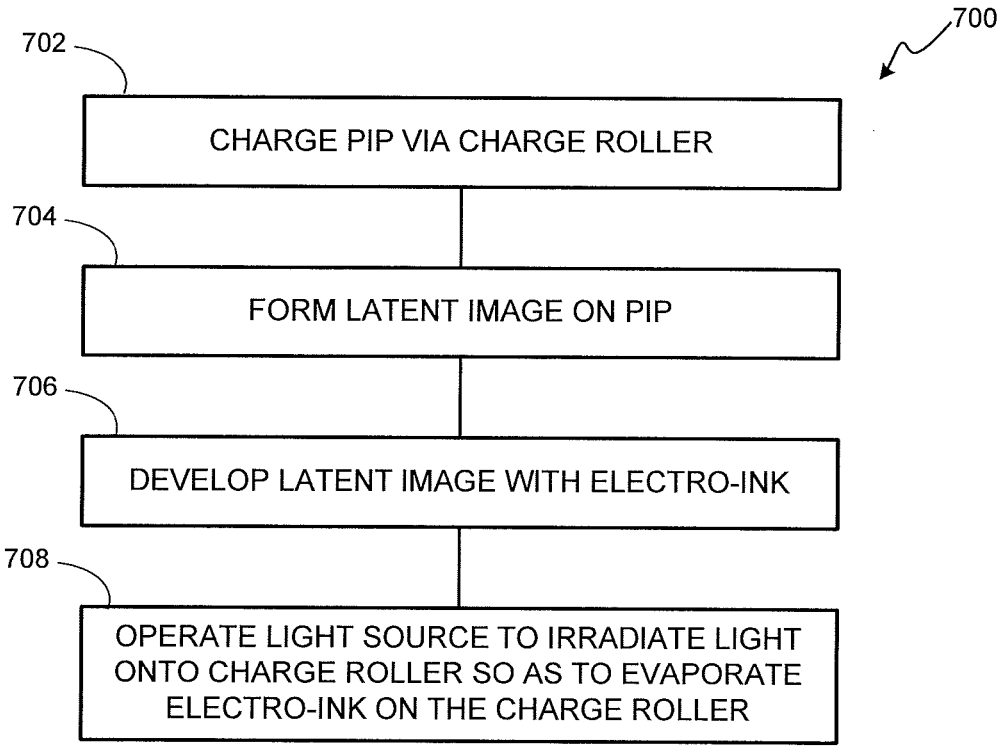

FIGS. 5 to 7 show flow charts for implementing at least some of the examples disclosed herein. In discussing these Figures, reference is made to FIGS. 1 to 4 to provide contextual examples. Implementation, however, is not limited to those examples.

FIG. 5 shows a flow chart 500 to operate a liquid electrographic printer (e.g., any of printers 100, 200, 400 illustrated above with respect to FIGS. 1, 2, and 4) including a charge roller for charging a photo imaging plate (PIP). At block 502, the charge roller is heated by irradiation with light. For example, referring to FIG. 2, charge roller 208 may be heat via light 110 irradiated by light source 108. The example of FIG. 5 may be analogously applied to any other charge element and is not limited to charge rollers.

FIG. 6 shows a flow chart 600 illustrating a more detailed example on how a charge element might be heated by irradiation of light. More specifically, flow chart 600 illustrates examples, in which the heating at block 502 is to maintain a charge roller to a selected temperature.

At block 602, a charge element temperature may be acquired. For example, referring to FIG. 2, temperature acquisition system 232 may acquire temperature of charge roller 208 during operation of printer 200. The acquired temperature may be a transducer parameter (e.g., a measured current, voltage) or a transduced temperature value.

At block 604, a selected temperature 606 is compared to the charge element temperature acquired at block 602. For example, it might be determined whether the acquired temperature is within a certain range of selected temperature.

The selected temperature may, for example, be a temperature between 40° C. and 60° C. such as 50° C. It will be understood that the selected temperature may vary depending on the specific printer and printer parameters and, in particular, of the characteristics of the used electro-ink. Generally, selected temperature 606 is a charge roller temperature selected to prevent that a layer of electro-ink is formed on the charge element during operation of the printer.

At block 608, the charge element is heat by irradiation thereof so as to maintain its temperature at selected temperature 606. Block 608 may be implemented via a temperature control, which might be an open or a closed loop that strives to maintain the charge element temperature within a certain range of temperatures or directly targets a specific temperature. It will be understood that, during the maintaining, the charge roller may vary due to control tolerances or to the nature of the control (for example, the selected temperature may be a range of temperatures).

In at least some examples herein, the irradiated light has an absorption band of electro-ink used for printing via the printing system. For example, referring to FIG. 4, the temperature of lamp 408 may be set to irradiate light at a wavelength that contamination at charge roller 402 significantly absorbs. For example, if the used electro-ink contains Isopar-L, or other alkanes, as carrier, then the contamination at charge roller 402 may substantially consists of these alkanes evaporated somewhere in printer 400 and condensed onto the roller external surface. Then, lamp 408 may be provided to irradiate light with a wavelength which is in the absorption band of the alkanes. Looking at FIG. 3, this absorption band might be a 3.4 μm. Thereby, it can suitably promote evaporation of condensation on the charge roller before it polymerizes.

In at least some examples herein, the heating of the charge roller via irradiation includes irradiating the charge roller with light having a power selected to sufficiently evaporate electro-ink on the charge roller. Power selection may be performed via the lamp regulation set forth above with respect to FIG. 4.

This value of the power to be selected may be predetermined by taking into account print parameters such as evaporation heat of contamination on the charge element, an expected mass of the contamination at the charge roller, and the absorption band of the contamination. Such a selection is illustrated in the following referring to the example of FIG. 3.

In the example of FIG. 3, potential contamination on the charge roller substantially consists of Isapor-L. Heat of evaporation for Isopar-L is 284 J/g at 100° C. and can be extrapolated to approximately 300 J/g at 50° C. A mass of a monolayer of Isopar-L on a charge roller being 34 cm long under a lamp which is 20 cm long is 1.2 μg. The energy required to evaporate such a monolayer of Isopar-L on the charge roller can hence be estimated to be approximately 360 μJ. If the monolayer is formed (condensed) every second, the required power to remove this Isopar-L layer is 360 μW. Referring to graph 300 in FIG. 3, the portion of radiation power from the lamp (180 W) within the absorption band (100 nm centered at 3.4 μm) of Isopar-L is of approximately 4 W. The portion of this radiation power that is absorbed by the monolayer is of approximately 0.005%, which is 200 μW. This means that Isopar-L condensation rate may be expected to be lower than the expected monolayer/sec evaporation layer for this specific printer environment. Power might be adjusted for optimizing the expected monolayer/sec evaporation.

FIG. 7 shows flow chart 700 illustrating further examples of operating a liquid electrographic printer. In the following, details of flow chart 700 are illustrated referring to printer 200 described above with regard to FIG. 2. It will be understood that these examples are not limited to this specific printer configuration. In particular, these examples are not limited to a charge roller but might be implemented using other charge elements such as, but not limited to, a corona wire.

At block 702, PIP 220 is charged via charge roller 208. At block 704, a latent image (not depicted) is formed on PIP 220. For example, imager unit 209 may form an electrostatic image on charged PIP section 221 by scanning one or more laser beams 224. On block 706, the latent image formed at block 704 is developed with electro-ink. For example, developers 204 may ink a section of PIP 220 containing a portion of a latent image with charged electro-ink from electro-ink suppliers 202.

At block 708, light source 108 is operated to irradiate light 110 onto charge roller 208 so as to evaporate at least a portion of electro-ink on charge roller 208. As used herein, "at least a portion of electro-ink" refers to one or more components from the electro-ink such as an ink carrier (e.g. Isopar-L or other alkanes) and other elements originally on the electro-ink that may contaminate charge roller 208.

Operation of light source 108 at block 708 might be performed in an open-loop mode or in a closed-loop mode.

Open-loop control may include operating light source 108 at selected time intervals with selected operating parameters. For some specific application, open-loop control might be suitable since the range of temperatures that attenuate charge roller contamination might be wide and the contamination creation process might be sufficiently slow. Thereby, heating of charge roller 208 might not need tight control and few warming cycle at temperatures far from an optima value might render satisfactory results. Control via open loop might facilitate simplifying operation of the system.

Closed-loop control might be implemented as illustrated above with respect to FIG. 6 by monitoring the charge roller temperature via a suitable temperature acquisition system (e.g., an IR sensor, a contact thermocouple, or monitored current or resistance of the charge roller). The closed-loop is to dynamically modify the current or the duty cycle of the light source to maintain the temperature of the charge roller at a selected temperature. Control system 124 may be responsible for implementing the closed-loop control using charge roller temperature values acquired online via temperature acquisition system 232. The closed-loop control may include any suitable feedback loop control such as, but not limited to, a PID or PI control or an intelligent control-loop such as, but not limited to, a model based control loop.

It will be appreciated that examples above can be realized in the form of hardware, programming or a combination of hardware and the software engine. Any such software engine, which includes machine-readable instructions, may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of a tangible computer-readable storage medium that are suitable for storing a program or programs that, when executed, for example by a processor, implement embodiments. Accordingly, embodiments provide a program comprising code for implementing a system or method as claimed in any preceding claim and a tangible or intangible computer readable storage medium storing such a program. A tangible computer-readable storage medium is a tangible article of manufacture that stores data. (It is noted that a transient electric or electromagnetic signal does not fit within the former definition of a tangible computer-readable storage medium.)

In the foregoing description, numerous details are set forth to provide an understanding of the examples disclosed herein. However, it will be understood that the examples may be practiced without these details. While a limited number of examples have been disclosed, numerous modifications and variations therefrom are contemplated. For example, the printers illustrated in FIGS. 2 and 4 are shown to include a charge roller as a charge element; however, it will be understood that other charge elements might be implemented is those examples. It is intended that the appended claims cover such modifications and variations. Further, flow charts herein illustrate specific block orders; however, it will be understood that the order of execution may differ from that which is depicted. For example, the order of execution of two or more blocks may be scrambled relative to the order shown. Also, two or more blocks shown in succession may be executed concurrently or with partial concurrence. Further, claims reciting "a" or "an" with respect to a particular element contemplate incorporation of one or more such elements, neither requiring nor excluding two or more such elements. Further, at least the terms "include" and "comprise" are used as open-ended transitions.

What is claimed is:

1. A liquid electrographic printer, comprising:

a charging element for charging a photo imaging plate (PIP); and a light source to irradiate light onto the charge element, the irradiated light being to heat the charge element to a selected temperature.

2. The printer of claim 1, wherein the light source is an infrared light source.

3. The printer of claim 1, wherein the light source further includes a light reflector to reflect irradiated light towards the charge element.

4. The printer of claim 1, further including a housing for the charge element, the housing to prevent irradiated light from reaching the PIP during printer operation.

5. The printer of claim 4, wherein the housing includes a light baffle to block stray light from reaching the PIP.

6. The printer of claim 1, wherein the charge element includes a charge roller.

7. The printer of claim 6, wherein the charge roller is an inorganic charge roller.

8. The printer of claim 7, wherein the charge roller includes a body having a metal external surface and an overlying resistive coating made of an inorganic, non-polymeric material.

9. The printer of claim 6, wherein the charge roller is positioned so as to be, during printer operation, in a non-contact charge-transferring relation with the PIP.

10. A method of operating a liquid electrographic printer including a charge roller for charging a photo imaging plate (PIP), the method comprising:

heating the charge roller by irradiating the charge roller with light.

11. The method of claim 10, further including selecting a charge roller temperature that prevents formation of a layer of electro-ink onto the charge roller during operation of the printer, the heating being to maintain the charge roller to the selected temperature.

12. The method of claim 10, wherein the irradiated light includes light in an absorption band of electro-ink used for printing via the printer.

13. The method of claim 10, wherein the heating includes irradiating the charge roller with light having a power selected to sufficiently evaporate electro-ink on the charge roller.

14. A computer software product comprising a tangible medium readable by a processor, the medium having stored thereon a set of instructions for operating a liquid electrographic printer including a charge roller for charging a photo imaging plate (PIP), the instructions comprising:

a set of instructions which, when loaded into a memory and executed by the processor, causes charging the PIP via the charge roller;

a set of instructions which, when loaded into a memory and executed by the processor, causes formation of a latent image on the PIP;

a set of instructions which, when loaded into a memory and executed by the processor, causes developing the latent image with electro-ink;

a set of instructions which, when loaded into a memory and executed by the processor, causes operating a light source to irradiate light onto the charge roller so as to evaporate at least a portion of electro-ink formed on the charge roller.

15. The product of claim 14, further including a set of instructions which, when loaded into a memory and executed by the processor, causes closed-loop control of the irradiated light to maintain temperature of the charge roller at a selected temperature.

* * * * *